US007426886B2

(12) United States Patent
Spatafora

(10) Patent No.: US 7,426,886 B2
(45) Date of Patent: Sep. 23, 2008

(54) EMBOSSING DEVICE

(75) Inventor: Mario Spatafora, Via Silone (IT)

(73) Assignee: G.D Societa'Per Azioni, Bologna (IT)

( * ) Notice: Subject to any disclaimer, the term of this patent is extended or adjusted under 35 U.S.C. 154(b) by 426 days.

(21) Appl. No.: 11/255,181

(22) Filed: Oct. 21, 2005

(65) Prior Publication Data

US 2006/0107848 A1 May 25, 2006

(30) Foreign Application Priority Data

Nov. 19, 2004 (IT) ..... BO2004A0718

(51) Int. Cl.
*B41F 19/02* (2006.01)
*B31F 1/07* (2006.01)

(52) U.S. Cl. ..... 101/23; 101/6; 101/24; 425/367; 156/209; 264/284; 162/362

(58) Field of Classification Search ..... 101/5, 101/6, 22, 23, 24, 26, 28, 32; 425/363, 365, 425/367; 156/209; 264/284; 162/361, 362
See application file for complete search history.

(56) References Cited

U.S. PATENT DOCUMENTS 2,433,965 A * 1/1948 Upson ..... 156/280
2,464,301 A * 3/1949 Francis, Jr. ..... 428/167
4,189,344 A * 2/1980 Busker ..... 162/117
4,682,540 A * 7/1987 Eastman et al. ..... 101/32
5,007,271 A * 4/1991 Boegli ..... 72/196
5,269,983 A 12/1993 Schulz
5,913,765 A 6/1999 Burgess et al.

FOREIGN PATENT DOCUMENTS

DE 4 342 737 6/1995
WO WO 02/30661 4/2002

OTHER PUBLICATIONS

Search Report for related European Application No. 05110781.1 dated Apr. 5, 2006.

* cited by examiner

*Primary Examiner*—Ren Yan
(74) *Attorney, Agent, or Firm*—Harness, Dickey, & Pierce, P.L.C.

(57) ABSTRACT

An embossing device having a first embossing unit for satin finishing a strip of packing material, and a second embossing unit for impressing graphics on the strip of packing material; the second embossing unit has two embossing rollers, at least one of which only has embossing pins in areas for impressing the graphics.

18 Claims, 5 Drawing Sheets

EMBOSSING DEVICE

The present invention relates to an embossing device.

The present invention may be used to particular advantage in the manufacture of packets of cigarettes, to which the following description refers purely by way of example.

BACKGROUND OF THE INVENTION

Packing material is known to be embossed or satin finished by feeding it between two embossing rollers, each of which has an outer surface with a number of impression pins which cooperate with the impression pins on the other roller to satin finish the packing material.

Patent Application WO 0230661 A1 describes an embossing device, in which a roller comprises pins of different geometric shapes, and the difference in shape of the pins provides for impressing graphics on the packing material.

The embossing rollers described in Patent Application WO 0230661 A1 are fairly complex and therefore expensive to produce, and must be changed alongside a change in format, so that producing a number of packing materials of different formats calls for a large number of different, high-cost embossing rollers.

U.S. Pat. No. 5,913,765 discloses an embossing device comprising two pairs of embossing rollers; each pair is designed to emboss a respective pattern on the embossing material.

Also the embossing rollers disclosed in U.S. Pat. No. 5,913,765 must be changed alongside a change of format so that producing a number of packing materials of different formats calls for a large number of different, high-cost embossing rollers.

SUMMARY OF THE INVENTION

It is an object of the present invention to provide an embossing device designed to eliminate, at least partially, the aforementioned drawbacks.

According to the present invention, there is provided an embossing device as claimed in the attached claims.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
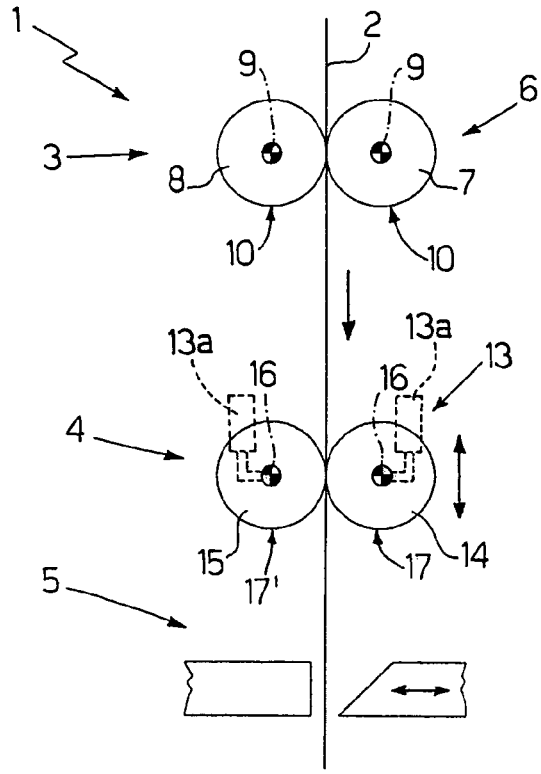
FIG. 1 shows, schematically, one embodiment of a device in accordance with the present invention.

Number 1 in FIG. 1 indicates as a whole an embossing device for satin finishing a strip of packing material 2 and impressing graphics G (e.g. letters and/or designs—FIG. 10) on the strip of packing material 2.

Figure 10:
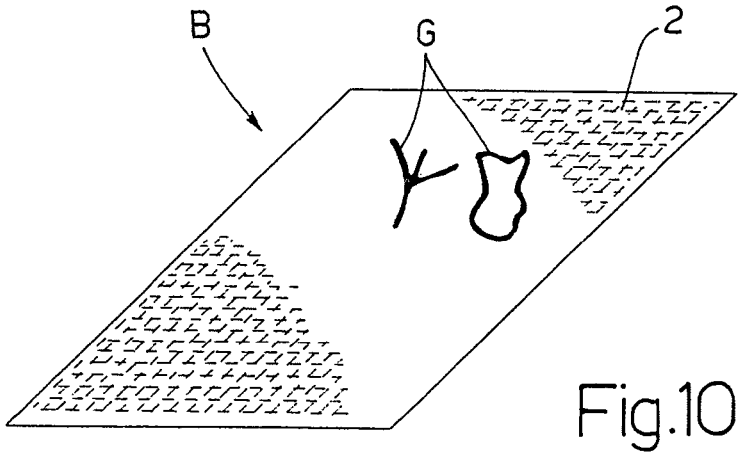
FIG. 10 shows a view in perspective of a portion of packing material obtainable using a device in accordance with the present invention.

Device 1 comprises a feed unit (not shown) for feeding the strip of packing material 2 along a given path through an embossing station 3, an embossing station 4 downstream from embossing station 3, and a cutting station 5 downstream from embossing station 4 and where a cutting unit cuts the strip of packing material 2 transversely into portions B of satin finished packing material 2 (FIG. 10).

Device 1 also comprises an embossing unit 6 located at embossing station 3 and for satin finishing packing material 2.

Figure 2:
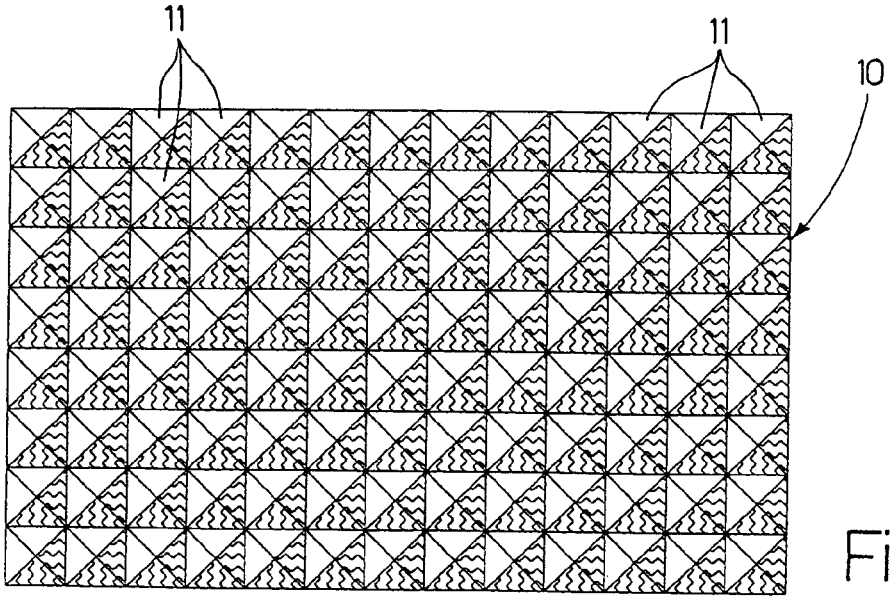
FIG. 2 shows a larger-scale view of one embodiment of a detail of the FIG. 1 device.

Embossing unit 6 comprises two embossing rollers 7 and 8, each having a respective axis of rotation 9, and a respective longitudinal outer surface 10 substantially parallel to respective axis of rotation 9. Axes of rotation 9 are substantially parallel, and each outer surface 10 has a respective number of impression pins 11, which cooperate with the impression pins 11 on the other outer surface 10 to satin finish the strip of packing material 2 (so-called pin up-pin up embossing configuration). With reference to FIG. 2, which shows a portion of one of outer surfaces 10, each impression pin 11 is substantially pyramid-shaped. In an alternative embodiment not shown, only one embossing roller 7 has impression pins 11, and the outer surface 10 of the other embossing roller 8 is covered with elastic material.

Figure 5:
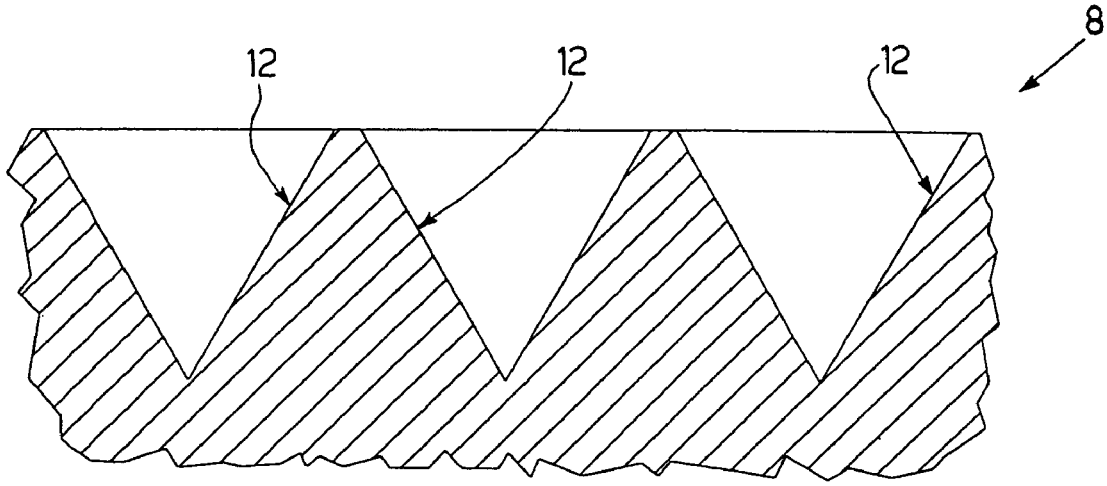
FIG. 5 shows a larger-scale section of a detail of one embodiment of the FIG. 1 device.

In a further embodiment, only one embossing roller 7 has impression pins 11, and the outer surface 10 of the other embossing roller 8 has a number of cavities 12, each for housing a pin 11 of embossing roller 7 (so-called pin up-pin down embossing configuration). FIG. 5 shows a larger-scale section of cavities 12 of embossing roller 8.

Device 1 also comprises an embossing unit 13 located at embossing station 4 and for impressing graphics G on packing material 2.

Embossing unit 13 comprises two embossing rollers 14, 15, each having a respective axis of rotation 16, and a respective longitudinal outer surface 17, 17' substantially parallel to respective axis of rotation 16. Axes of rotation 16 are substantially parallel.

Figure 7:
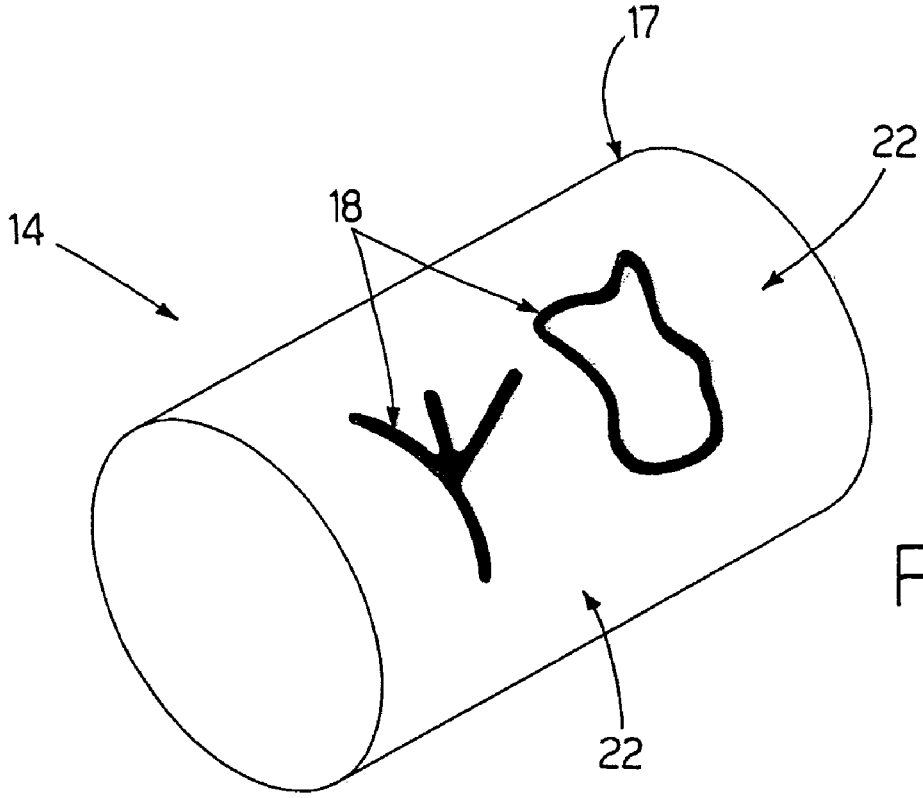
FIG. 7 shows a view in perspective of one embodiment of a member of the FIG. 1 device.
Figure 8:
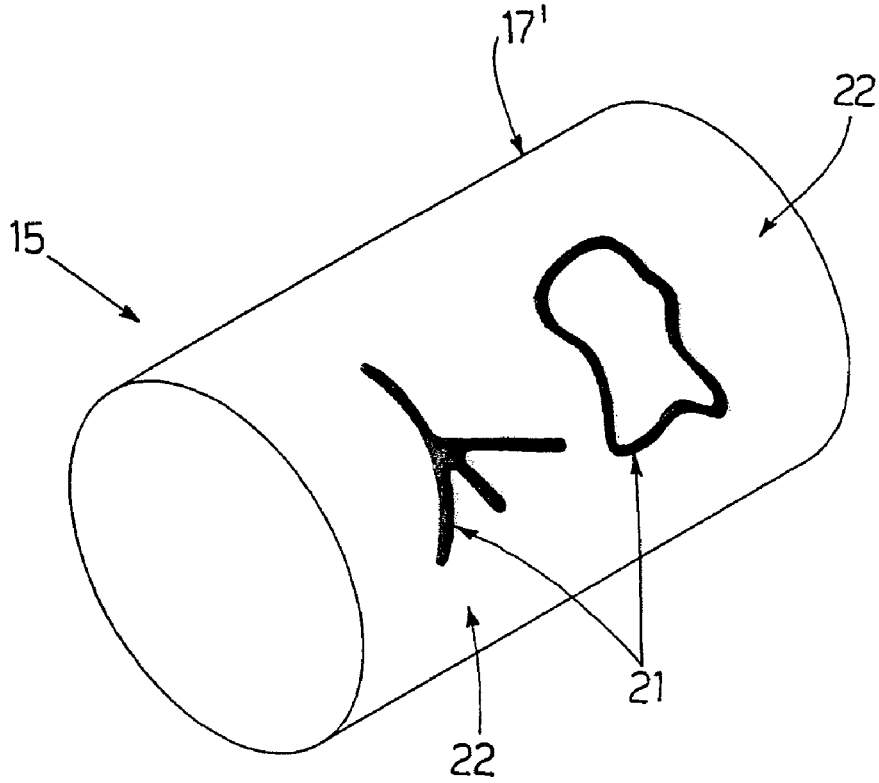
FIG. 8 shows a view in perspective of one embodiment of a member of the FIG. 1 device.

With particular reference to FIG. 7, outer surface 17 of embossing roller 14 comprises impression areas 18 having a number of impression pins 19 (FIGS. 3 and 4), which cooperate with impression pins 20 of impression areas 21 on outer surface 17' of the other embossing roller 15 (FIG. 8) to impress graphics G on packing material 2 (so-called pin up-pin up embossing configuration). Impression areas 18 and 21 are substantially the same shape as the graphics G to be impressed.

It should be noted that pins 19 and 20 may differ in shape from pins 11.

Portions 22 of outer surfaces 17 and 17' outside impression areas 18 and 21 are substantially smooth; and impression areas 18 and 21 are raised with respect to substantially smooth portions 22. Preferably, impression areas 18 and respective portions 22 define outer surface 17; and impression areas 21 and respective portions 22 define outer surface 17'. The term "substantially smooth portions" is intended to mean surface portions with no impression pins.

Figure 3:
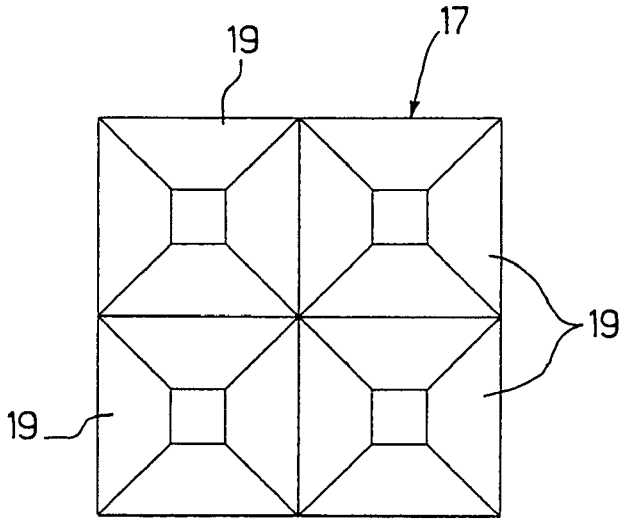
FIG. 3 shows a larger-scale view of one embodiment of a detail of the FIG. 1 device.
Figure 4:
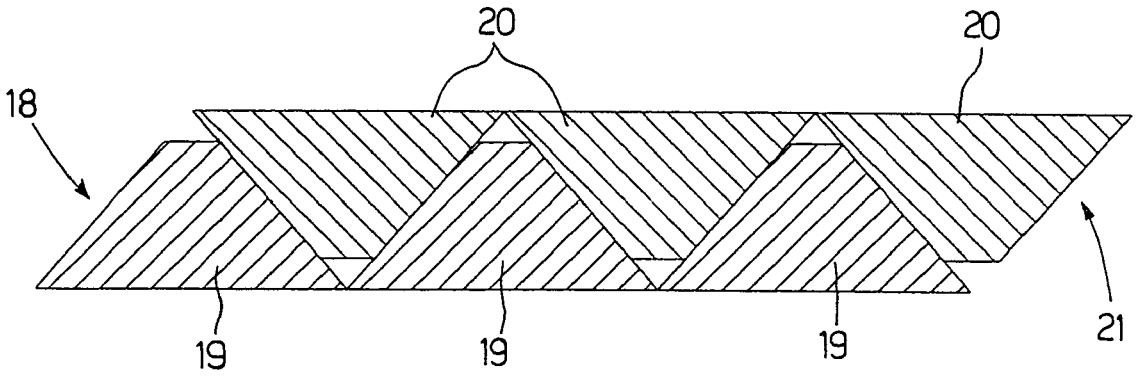
FIG. 4 shows a larger-scale section of a detail of one embodiment of the FIG. 1 device.

FIG. 4 shows impression pins 19 of impression areas 18 meshing with impression pins 20 of impression areas 21. As shown in FIGS. 3 and 4, impression pins 19 and 20 are truncated-cone-shaped.

Embossing unit 13 also comprises actuating members 13*a* (schematically shown in dotted line in FIG. 1) for moving embossing rollers 14 and 15, along the path of the strip of packing material 2, towards or away from cutting station 5, thus enabling the format of portion B of packing material 2 to be changed, at times, without changing embossing unit 13. According to non limiting embodiments, each actuating member 13*a* may comprise: an electric motor, a fluid-dynamic (e.g. pneumatic) device, a mechanic device (e.g. a gear system) and/or any other suitable device.

Actuating members 13*a* may be connected to a control unit (not shown) having a Human Machine Interface (HMI, e.g. a monitor and a keyboard), through which an operator may input data to the control unit (not shown). The control unit is designed to control actuating members 13*a* as a function of the inputted data.

In an alternative embodiment not shown, only embossing roller 14 has impression pins 19, and the outer surface 17' of the other embossing roller 15 is covered with elastic material.

Figure 6:
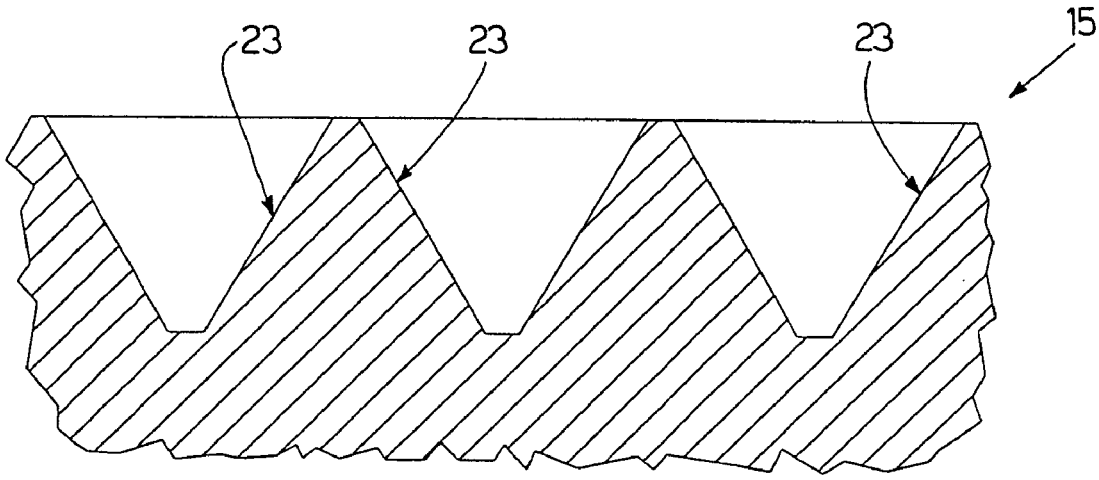
FIG. 6 shows a larger-scale section of a detail of one embodiment of the FIG. 1 device.

In a further embodiment, only one embossing roller 14 has impression pins 19; and the outer surface 17' of the other embossing roller 15 has a number of cavities 23, each for housing an impression pin 19 on embossing roller 14 (so-called pin up-pin down embossing configuration). FIG. 6 shows a larger-scale section of cavities 23 of embossing roller 15.

In a further embodiment not shown, impression pins 19 are shaped differently from impression pins 20, e.g. may be higher than impression pins 20. And impression pins 20 may be shaped differently from or be substantially the same shape as impression pins 11.

Different-shaped impression pins 11, 19, 20 provide for impressing graphics G with particular optical effects on packing material 2. Particularly interesting are the shape combinations producing graphics G, the intensity of which varies as a function of angle of observation and/or the direction and/or type of light.

Figure 9:
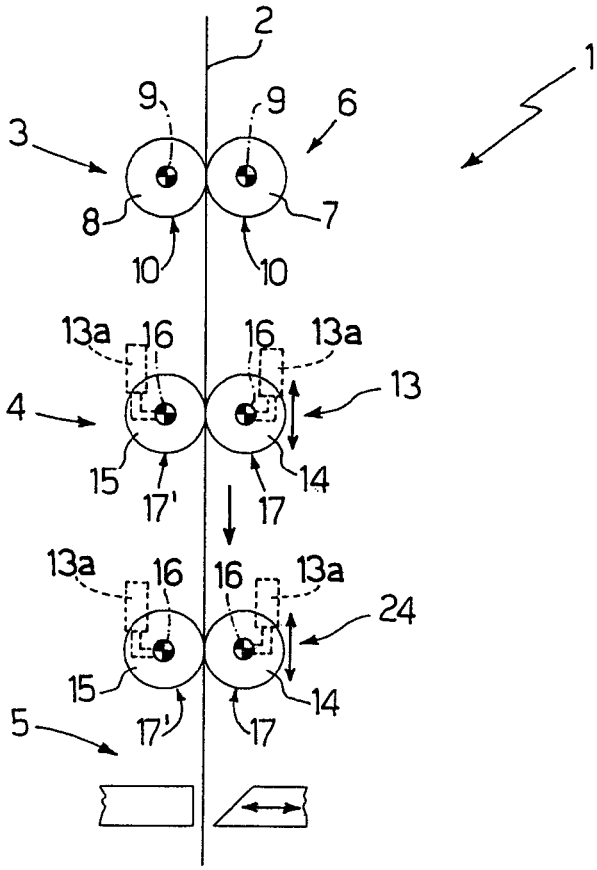
FIG. 9 shows, schematically, a further embodiment of a device in accordance with the present invention.

In the FIG. 9 embodiment, device 1 comprises a further embossing unit 24 located downstream from embossing unit 13 and upstream from cutting station 5, and for impressing further graphics G on packing material 2. Embossing unit 24 is substantially identical to embossing unit 13, except possibly for the shape of impression areas 18 and 21. By varying the relative position of embossing units 24 and 13, the relative position of the graphics on the packing material can be varied to achieve a fast, easy change in format.

It should be noted that, being movable, embossing units 13 and 24 also permit fast, easy fine adjustments, which are frequently advantageous during operation of device 1.

In alternative embodiments, pins 11, 19, 20 may be shaped differently from those described, and each shape may, for example, be selected independently of the others from a range comprising: conical, truncated-cone, pyramid, truncated-pyramid shapes.

The invention claimed is:

1. An embossing device comprising:

a first embossing unit having a first and a second embossing roller for satin finishing packing material fed between the first and second embossing roller;

a cutting unit for cutting the packing material into portions of packing material; and at least a second embossing unit for impressing at least one graphic on the packing material, the second embossing unit including a third and a fourth embossing roller, each of the third and fourth embossing rollers having a respective axis of rotation, the third and fourth embossing rollers having, respectively, a first and a second longitudinal outer surface, each parallel to the respective axis of rotation;

at least one longitudinal outer surface, selected from the first and second longitudinal outer surfaces, having at least one impression area of substantially the same shape as the graphic for impressing the graphic on the packing material as the packing material is fed between the third and fourth embossing rollers;

wherein the second embossing unit is movable with respect to the cutting unit.

2. A device as claimed in claim 1, wherein the at least one impression area for impressing the graphic includes a number of first impression pins.

3. A device as claimed in claim 2, wherein the first and second embossing rollers each include a respective axis of rotation, a respective longitudinal outer surface parallel to the respective axis of rotation, and a number of second impression pins for satin finishing the packing material, the first impression pins being shaped differently from the second impression pins.

4. A device as claimed in claim 1, wherein the first and second embossing rollers each include a respective axis of rotation, a respective longitudinal outer surface parallel to the respective axis of rotation, and a number of second impression pins for satin finishing the packing material; the first and second longitudinal outer surfaces each having at least one respective impression area; the impression areas of the first and second longitudinal outer surfaces cooperating to impress said graphic on the packing material; the impression area of the first longitudinal outer surface having a number of first impression pins; the impression area of the second longitudinal outer surface having a number of third impression pins; and the first impression pins being shaped differently from the second impression pins.

5. A device as claimed in claim 4, wherein the first impression pins are substantially the same shape as the third impression pins.

6. A device as claimed in claim 4, wherein the first impression pins are shaped differently from the third impression pins.

7. A device as claimed in claim 6, wherein the third impression pins are shaped differently from the second impression pins.

8. A device as claimed in claim 6, wherein the third impression pins are substantially the same shape as the second impression pins.

9. A device as claimed in claim 1, wherein the first and second longitudinal outer surfaces each include at least one respective impression area, the impression areas of the first and second longitudinal outer surfaces cooperating to impress said graphic on the packing material.

10. A device as claimed in claim 1, wherein the first and second longitudinal outer surfaces each include at least one respective substantially smooth portion.

11. A device as claimed in claim 10, wherein the impression area is raised with respect to the relative substantially smooth portion.

12. A device as claimed in claim 10, wherein the impression area and the relative substantially smooth portion define the longitudinal outer surface of the respective embossing roller.

13. A device as claimed in claim 1, wherein the second embossing unit is located downstream from the first embossing unit.

14. A device as claimed in claim 1, wherein the cutting unit is located downstream from the first and the second embossing units.

15. A device as claimed in claim 1, further including first actuating means for moving the second embossing unit with respect to the cutting unit.

16. A device as claimed in claim 1, further including at least a third embossing unit selected independently of the second embossing unit; the second and third embossing units being located one downstream from the other, and being movable with respect to each other.

17. A device as claimed in claim 16, further including second actuating means for moving the third embossing unit with respect to the second embossing unit.

18. A device as claimed in claim 17, wherein the second actuating means moves the third embossing unit with respect to the cutting unit.

* * * * *